US011220396B2

(12) United States Patent
Tsuchida et al.

(10) Patent No.: US 11,220,396 B2
(45) Date of Patent: Jan. 11, 2022

(54) PACKAGE BODY AND METHOD OF MANUFACTURING PACKAGE BODY

(71) Applicant: Sumitomo Electric Toyama Co., Ltd., Imizu (JP)

(72) Inventors: Hitoshi Tsuchida, Imizu (JP); Tadashi Omura, Imizu (JP); Toshitaka Nakagawa, Imizu (JP); Kengo Tsukamoto, Imizu (JP)

(73) Assignee: SUMITOMO ELECTRIC TOYAMA CO., LTD., Imizu (JP)

( * ) Notice: Subject to any disclaimer, the term of this patent is extended or adjusted under 35 U.S.C. 154(b) by 0 days.

(21) Appl. No.: 16/973,044

(22) PCT Filed: Mar. 24, 2020

(86) PCT No.: PCT/JP2020/013030
§ 371 (c)(1),
(2) Date: Dec. 8, 2020

(87) PCT Pub. No.: WO2020/250539
PCT Pub. Date: Dec. 17, 2020

(65) Prior Publication Data

US 2021/0261322 A1 Aug. 26, 2021

(30) Foreign Application Priority Data

Jun. 12, 2019 (JP) ..... JP2019-109464

(51) Int. Cl.
*B65D 85/672* (2006.01)
*B65D 81/03* (2006.01)
*B65D 85/30* (2006.01)

(52) U.S. Cl.
CPC ..... *B65D 85/672* (2013.01); *B65D 81/03* (2013.01); *B65D 85/30* (2013.01)

(58) Field of Classification Search
CPC ..... B65D 81/03; B65D 85/30; B65D 85/67; B65D 85/672; B65H 73/00; B65H 75/00; B65H 75/14
USPC ..... 206/389–416
See application file for complete search history.

(56) References Cited

U.S. PATENT DOCUMENTS 3,156,357 A * 11/1964 William ..... C21D 9/54 206/410
7,325,691 B2 * 2/2008 Siy ..... B65D 19/02 206/600
2012/0067731 A1 3/2012 Hosoe et al.
(Continued)

FOREIGN PATENT DOCUMENTS

FR 2397355 A1 * 2/1979 ..... B65H 75/187
JP 50-119718 U 9/1975
JP 61-119561 U 7/1986
(Continued)

*Primary Examiner* — Bryon P Gehman
(74) *Attorney, Agent, or Firm* — Xsensus LLP

(57) ABSTRACT

A package body includes a porous metal body having an elongated sheet shape, a core member having a cylindrical shape, a protective sheet, and a resin film. The porous metal body is wound around the core member. The protective sheet is wound around the wound porous metal body to cover an outer surface of the wound porous metal body. The protective sheet and the porous metal body are covered with the resin film. The core member is made of paper or a resin.

14 Claims, 15 Drawing Sheets

(56) References Cited

U.S. PATENT DOCUMENTS

| | | | | |
|---|---|---|---|---|
| 2016/0079006 | A1 | 3/2016 | Hosoe et al. | |
| 2021/0122562 | A1* | 4/2021 | Casas | B65H 75/10 |

FOREIGN PATENT DOCUMENTS

| | | | |
|---|---|---|---|
| JP | 63-21676 | U | 2/1988 |
| JP | 2-2367 | U | 1/1990 |
| JP | 2-86975 | U | 7/1990 |
| JP | 5-31446 | A | 2/1993 |
| JP | 5-77174 | U | 10/1993 |
| JP | 2001-88990 | A | 4/2001 |
| JP | 2005-104651 | A | 4/2005 |
| JP | 2011-225950 | A | 11/2011 |
| JP | 2011-230918 | A | 11/2011 |
| JP | 2013-179879 | A | 9/2013 |
| JP | 2014-220328 | A | 11/2014 |
| JP | 3213770 | U | 11/2017 |
| JP | 2018-95271 | A | 6/2018 |
| WO | 2017/164352 | A1 | 9/2017 |

* cited by examiner

PACKAGE BODY AND METHOD OF MANUFACTURING PACKAGE BODY

CROSS-REFERENCE TO RELATED APPLICATIONS

The present application is based on PCT filing PCT/JP2020/013030, filed Mar. 24, 2020, which claims priority to JP 2019-109464, filed Jun. 12, 2019, the entire contents of each are incorporated herein by reference.

TECHNICAL FIELD

The present disclosure relates to a package body and a method of manufacturing the package body.

BACKGROUND ART

A sheet-shaped porous metal body having a framework of a three-dimensional mesh structure is utilized for various applications such as a filter that requires heat resistance, a battery electrode plate, a catalyst carrier, and a metal composite. For example, Celmet (manufactured by Sumitomo Electric Industries, Ltd., registered trademark), which is a porous metal body made of nickel, is widely adopted in various industrial fields, as an electrode of an alkaline storage battery such as a nickel hydrogen battery, a carrier for an industrial deodorizing catalyst, and the like. In addition, Aluminum-Celmet (manufactured by Sumitomo Electric Industries, Ltd., registered trademark), which is a porous metal body made of aluminum, can be used as a positive electrode of a lithium ion battery since it is stable even in an organic electrolytic solution.

As a method of manufacturing the porous metal body, the porous metal body can be manufactured by performing conductive treatment on a surface of a framework of a porous resin body, then performing electroplating treatment to provide metal plating on the surface of the framework of the porous resin body, and then removing the porous resin body (for example, see Japanese Patent Laying-Open No. 05-031446 (PTL 1) and Japanese Patent Laying-Open No. 2011-225950 (PTL 2)).

CITATION LIST

Patent Literature

PTL 1: Japanese Patent Laying-Open No. 05-031446
PTL 2: Japanese Patent Laying-Open No. 2011-225950

SUMMARY OF INVENTION

A package body according to one embodiment of the present disclosure includes: a porous metal body having an elongated sheet shape; a core member having a cylindrical shape and made of paper or a resin, wherein the porous metal body is wound around the core member; a protective sheet wound around the wound porous metal body to cover the wound porous metal body; and a resin film covering the protective sheet and the wound porous metal body.

A method of manufacturing a package body according to one embodiment of the present disclosure is a method for manufacturing the package body according to one embodiment of the present disclosure as described above, and includes: winding a porous metal body having an elongated sheet shape around a core member having a cylindrical shape, the core member being made of paper or a resin; winding a protective sheet around the wound porous metal body to cover the wound porous metal body; and covering the protective sheet and the wound porous metal body with a resin film.

DETAILED DESCRIPTION

Figure 1:
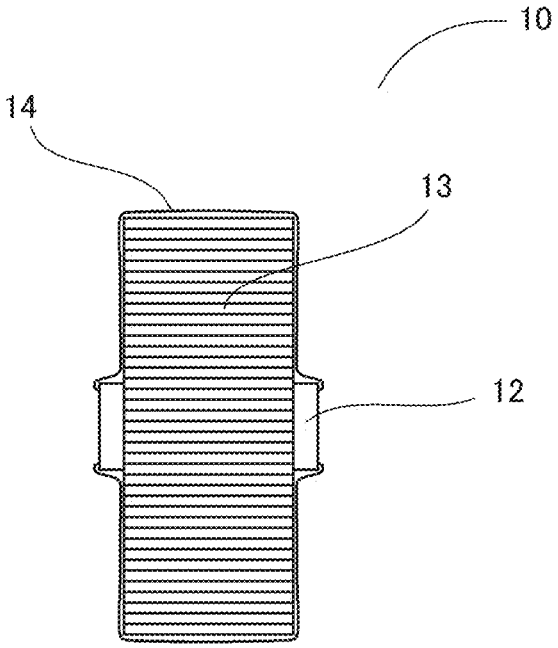
FIG. 1 is a diagram showing a schematic front view of an example of a package body according to an embodiment of the present disclosure.

Problem to be Solved by the Present Disclosure

For industrial mass production of the porous metal body, the porous metal body is continuously manufactured using an elongated sheet-shaped resin molded body as a base material. Furthermore, the end portion of the porous metal body in its short side direction is cut as required such that the porous metal body has a desired length in the short side direction. In the case where the porous metal body having an elongated sheet shape is conveyed as a product, a package body is formed by winding the porous metal body, in a rolled shape, around a structural member for packaging.

The structural member for packaging, which is used for a porous metal body, has generally been formed of a core member made of metal and having both ends provided with flanges made of metal. However, a structural member made of metal was heavy in weight, and therefore, was burdensome to be conveyed. Furthermore, the core member and the flange were integrally fixed to each other. Thus, a structural member for packaging needed to be prepared according to the length of the porous metal body in its short side direction, which also caused a problem of difficulty in flexibly changing the specifications of the porous metal body. Furthermore, there was also a problem that a remaining amount of the porous metal body that was still wound was hard to be visually checked at a glance when the porous metal body was unreeled from the package body.

Accordingly, in order to solve the above-described problems, the present disclosure aims to provide a lightweight package body that allows easy winding and unreeling of a porous metal body.

Advantageous Effect of the Present Disclosure

The present disclosure can provide a lightweight package body that allows easy winding and unreeling of a porous metal body.

DESCRIPTION OF EMBODIMENTS

The embodiments of the present disclosure will be first listed below for explanation.

(1) A package body according to one embodiment of the present disclosure includes: a porous metal body having an elongated sheet shape; a core member having a cylindrical shape and made of paper or a resin, the porous metal body being wound around the core member; a protective sheet wound around the wound porous metal body to cover the wound porous metal body; and a resin film covering the protective sheet and the wound porous metal body.

According to an aspect disclosed in the above (1), a lightweight package body that allows easy winding and unreeling of a porous metal body can be provided.

(2) In the package body according to the above (1), it is preferable that the core member has a hollow portion in which a reinforcement member is provided.

According to an aspect disclosed in the above (2), a package body can be provided that includes a core member increased in strength to thereby allow a core member having a larger outer diameter and allow winding of a porous metal body having a larger basis weight.

(3) In the package body according to the above (1) or (2), it is preferable that the core member has an end portion provided with a flange having a disk shape or a polygonal shape.

According to an aspect disclosed in the above (3), a package body can be provided that includes a porous metal body having a side surface portion protected by a flange.

(4) In the package body according to the above (3), it is preferable that the flange is made of corrugated cardboard, paper, or a resin.

According to an aspect disclosed in the above (4), a lightweight package body that allows easy removal of a flange can be provided.

(5) In the package body according to the above (3) or (4), it is preferable that the flange has a multilayer structure formed by stacking two or more pieces of corrugated cardboard. It is preferable that each of the two or more pieces of corrugated cardboard includes an inner core sheet having a corrugated structure, and the two or more pieces of corrugated cardboard are stacked such that crests of the corrugated structure of one piece of corrugated cardboard extend in a direction displaced from a direction in which crests of the corrugated structure of each of other pieces of corrugated cardboard extend.

According to an aspect disclosed in the above (5), a lightweight package body including a flange having high strength can be provided.

The corrugated cardboard refers to a sheet having a configuration in which an inner core sheet is provided between an upper liner and a lower liner.

(6) The package body according to any one of the above (3) to (5) preferably includes a cramp ring. It is preferable that the flange is located between the wound porous metal body and the cramp ring.

According to an aspect disclosed in the above (6), a package body can be provided that allows a position of a flange on a core member to be fixed so as to prevent the flange from detaching during conveyance or the like of the package body.

(7) In the package body according to any one of the above (3) to (6), it is preferable that the flange is provided with an indication mark showing a direction in which the porous metal body is unreeled.

According to an aspect disclosed in the above (7), a package body can be provided, for which an unreeling direction can be readily visually checked when a porous metal body is unreeled from the package body.

(8) In the package body according to any one of the above (3) to (7), it is preferable that a difference between a distance from an outer circumferential surface of the core member to an outer circumferential end portion of the flange and a distance from the outer circumferential surface of the core member to an outer surface of the porous metal body wound around the core member is 3 cm or more and 50 cm or less.

According to an aspect disclosed in the above (8), a package body can be provided that includes a flange having an end portion that is less likely to be bent.

(9) In the package body according to any one of the above (1) to (8), it is preferable that the core member has an outer circumferential surface provided with a nonwoven fabric, and one end portion of the porous metal body in a long side direction is fixed between the core member and the nonwoven fabric.

According to an aspect disclosed in the above (9), a package body can be provided that allows a lower work burden during production since a porous metal body and a core member can be readily fixed to each other when the porous metal body is wound around the core member.

(10) In the package body according to any one of the above (1) to (9), it is preferable that the porous metal body has a framework having a three-dimensional mesh structure, and the framework has a hollow interior.

According to an aspect disclosed in the above (10), a package body can be provided that has a framework having a three-dimensional mesh structure and in which a lightweight porous metal body is packaged.

(11) In the package body according to any one of the above (1) to (10), it is preferable that the porous metal body has a porosity of 50% or more.

According to an aspect disclosed in the above (11), a lightweight package body can be provided, in which a porous metal body having high strength is packaged.

(12) In the package body according to any one of the above (1) to (11), it is preferable that a plurality of the package bodies are coupled in parallel.

According to an aspect disclosed in the above (12), a package body can be provided that allows collective handling of the package bodies according to any one of the above (1) to (11) as an integrated structure.

(13) In the package body according to any one of the above (1) to (12), it is preferable that no metal foreign matter adheres to the porous metal body.

According to an aspect disclosed in the above (13), a package body can be provided that includes a porous metal body to which no metal foreign matter adheres.

(14) A method of manufacturing a package body according to an embodiment of the present disclosure is a method for manufacturing the package body according to the above (1), and includes: winding a porous metal body having an elongated sheet shape around a core member having a cylindrical shape, the core member being made of paper or a resin; winding a protective sheet around the wound porous metal body to cover the wound porous metal body; and covering the protective sheet and the wound porous metal body with a resin film.

According to an aspect disclosed in the above (14), a method of manufacturing a package body can be provided, by which the package body according to the above (1) can be provided.

(15) The method of manufacturing a package body according to an embodiment of the present disclosure is a method for manufacturing the package body according to the above (3), and includes: winding a porous metal body having an elongated sheet shape around a core member having a cylindrical shape and having one end portion provided with a flange, the core member being made of paper or a resin; winding a protective sheet around the wound porous metal body to cover the wound porous metal body; attaching a flange to the other end portion of the core member; and covering the protective sheet, the wound porous metal body, and the flanges with a resin film.

According to an aspect disclosed in the above (15), a method of manufacturing a package body can be provided, by which the package body according to the above (3) can be provided.

(16) The method of manufacturing the package body according to the above (14) or (15) preferably includes removing metal foreign matter from the core member or from the core member and the flanges.

According to an aspect disclosed in the above (16), a method of manufacturing a package body including a porous metal body having no metal foreign matter adhering thereto can be provided.

[Details of Embodiments of the Present Disclosure]

The following is a more detailed explanation about specific examples of a package body and a method of manufacturing a package body according to embodiments of the present disclosure. The present invention is not limited to these examples, but is defined by the scope of the claims, and is intended to include any modifications within the scope and the meaning equivalent to the scope of the claims.

<Package Body>

Figure 2:
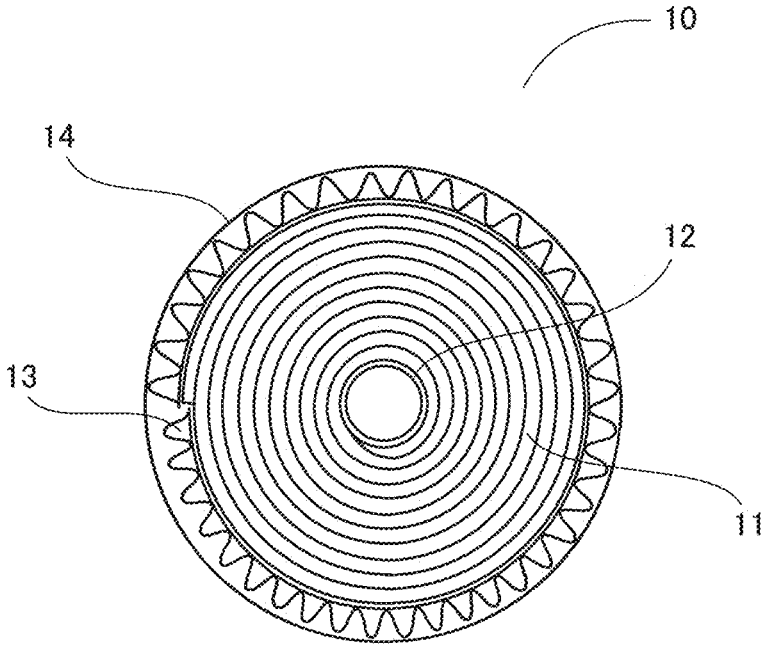
FIG. 2 is a schematic side view of the package body shown in FIG. 1.

FIG. 1 shows a schematic front view of an example of a package body according to an embodiment of the present disclosure, and FIG. 2 shows a schematic side view thereof.

A package body 10 according to an embodiment of the present disclosure includes a porous metal body 11 having an elongated sheet shape, a core member 12 having a cylindrical shape, a protective sheet 13, and a resin film 14, as shown in FIGS. 1 and 2. Porous metal body 11 is wound around core member 12 in a rolled shape. Furthermore, porous metal body 11 has an outer surface covered with protective sheet 13 and protected thereby. Furthermore, protective sheet 13 and porous metal body 11 are covered with resin film 14. Each of the configurations will be more specifically described below.

Figure 13:
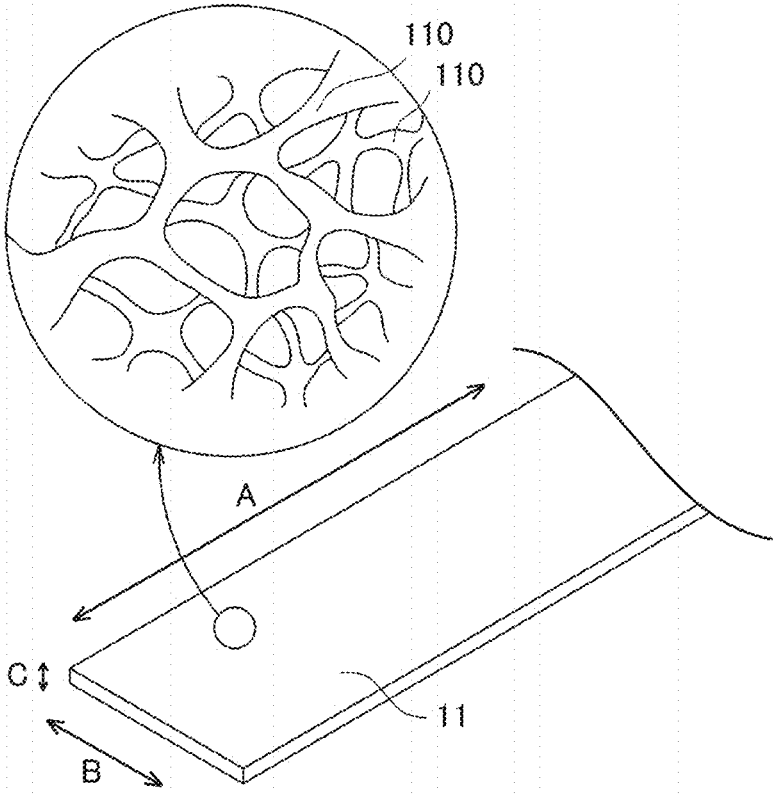
FIG. 13 is a schematic diagram showing an example of the porous metal body.
Figure 14:
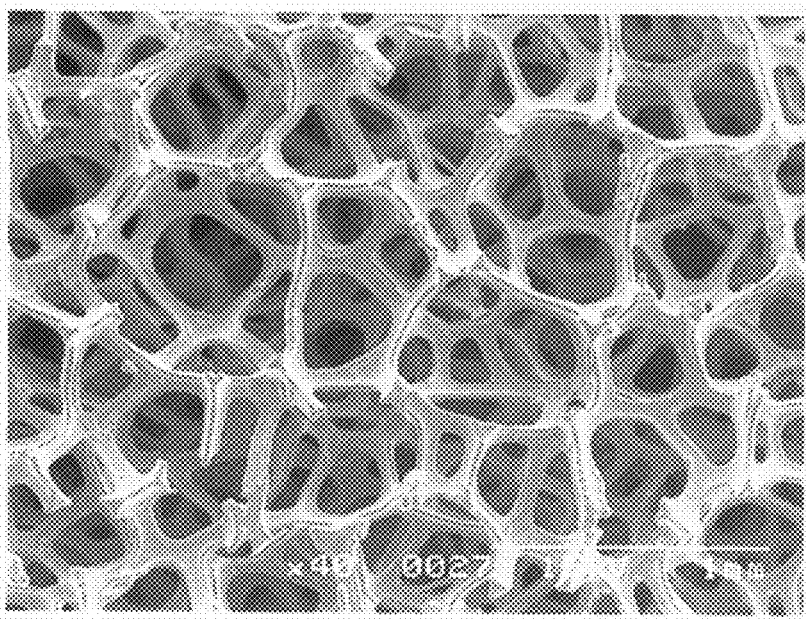
FIG. 14 shows a photograph of a cross section of an example of the porous metal body.
Figure 15:
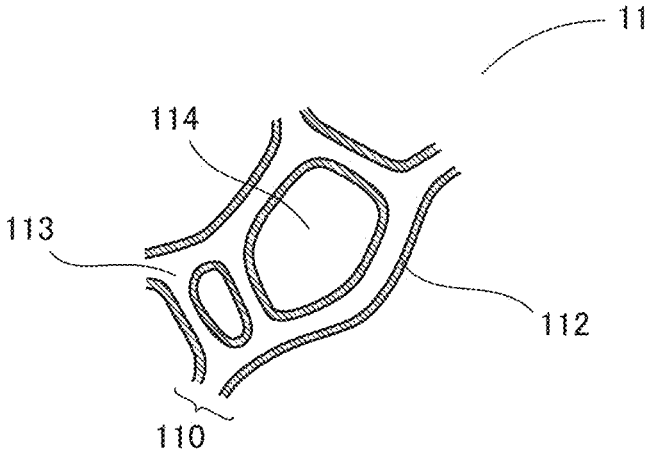
FIG. 15 is an enlarged view schematically showing a partial cross section of an example of the porous metal body.

FIG. 13 schematically shows an example of porous metal body 11 having an elongated sheet shape. FIG. 14 shows an enlarged photograph of a framework 110 having a three-dimensional mesh structure of porous metal body 11 shown in FIG. 13. FIG. 15 shows an enlarged schematic view showing a cross section of porous metal body 11 shown in FIG. 13 in an enlarged manner.

As shown in FIG. 1, it is preferable that porous metal body 11 has framework 110 having a three-dimensional mesh structure, and has an external appearance entirely formed in an elongated sheet shape. Pore portions 114 formed by framework 110 having a three-dimensional mesh structure are provided as communicating pores formed continuously from the surface of porous metal body 11 to the interior thereof. Framework 110 may be formed of a film 112 made of metal or an alloy. Examples of the metal may be nickel, aluminum, copper, or the like. Examples of the alloy may be an alloy formed by inevitably or intentionally adding another metal to the above-mentioned metal.

When framework 110 of porous metal body 11 has a shape having a three-dimensional mesh structure, an interior 113 of framework 110 is hollow, typically as shown in FIG. 15. Furthermore, pore portions 114 formed by framework 110 are provided as communicating pores as mentioned above.

The length of porous metal body 11 having an elongated sheet shape in a long side direction A is not particularly limited and may be about 10 m or more and about 600 m or less, for example. Furthermore, the length of porous metal body 11 in a short side direction B is also not particularly limited, and may be changed as appropriate, for example, in accordance with the application of porous metal body 11, the strength of a flange and a paper tube, and the weight (basis weight) of porous metal body 11. Short side direction B of porous metal body 11 is orthogonal to long side direction A and a thickness direction C of porous metal body 11 (see FIG. 13).

The thickness of porous metal body 11 may be selected as appropriate in accordance with the application of the porous metal body. The thickness of porous metal body 11 can be measured using a digital thickness gauge, for example. In many cases, by setting the thickness at 0.1 mm or more and 3.0 mm or less, a lightweight porous metal body having high strength can be formed. From the above-mentioned viewpoints, the thickness of porous metal body 11 is more preferably 0.2 mm or more and 2.5 mm or less, and further preferably 0.3 mm or more and 2.0 mm or less.

The average pore diameter of porous metal body 11 may be selected as appropriate in accordance with the application of porous metal body 11. The average pore diameter of porous metal body 11 is obtained as a result of calculation of the following equation using an average number (nc) of cell portions per inch (25.4 mm=25400 μm) that is obtained by observing the surface of porous metal body 11 in at least 10 fields of view with a microscope or the like.

$$\text{Average pore diameter}(\mu m)=25400\ \mu m/nc$$

It should be noted that the number of cells is measured according to Flexible Cellular Polymeric Materials; Method of Determining Number of Cells prescribed in JIS K6400-1:2004; Annex 1 (reference).

For example, when porous metal body 11 is used as a current collector of a battery, the average pore diameter of porous metal body 11 may be set in a range so as to achieve a suitable fill amount and a suitable utilized amount of an active material that fills pore portion 114. When porous metal body 11 is used as a filter, the average pore diameter is selected according to the size of particles to be captured.

In many cases, by setting the average pore diameter at 100 μm or more and 2000 μm or less, a lightweight and highly strong porous metal body can be obtained. From these viewpoints, the average pore diameter of porous metal body 11 is more preferably 200 μm or more and 1300 μm or less, and further preferably 250 μm or more and 900 μm or less.

The porosity of porous metal body 11 may be selected as appropriate in accordance with the application of porous metal body 11. The porosity of porous metal body 11 is defined by the following equation.

$$\text{Porosity } (\%)=[1-\{Mp/(Vp\times dp)\}]\times 100$$

Mp: mass of the porous metal body [g]

Vp: volume of the shape of an external appearance of the porous metal body [$cm^3$]

dp: density of the metal constituting the porous metal body [$g/cm^3$]

For example, when porous metal body 11 is used as a current collector of a battery, the porosity of porous metal body 11 may be set in a range so as to achieve a suitable fill amount and a suitable utilized amount of the active material that fills pore portion 114.

In many cases, by setting the porosity at 90% or more and 98% or less, a lightweight and highly strong porous metal body can be obtained. Furthermore, depending on the application of the porous metal body, the porous metal body having a porosity of about 90% or more and about 98% or less is compressed and reduced by about 1/10 in thickness to thereby allow formation of a porous metal body having a porosity of 50% or more.

In package body 10 according to an embodiment of the present disclosure, porous metal body 11 is wound around core member 12 in a rolled shape. Core member 12 may have a hollow cylindrical shape having a length longer than the length of porous metal body 11 in short side direction B.

The outer diameter of core member 12 is not particularly limited but may be selected as appropriate in accordance with the bending strength of porous metal body 11. For example, when porous metal body 11 has a hard framework with a relatively low bending strength, a core member having a large outer diameter may be used to prevent cracks and fractures from occurring at and near a portion of the framework of porous metal body 11 at which porous metal body 11 is started to be wound. Furthermore, a core member having a large outer diameter is used to allow formation of porous metal body 11 that is less likely to curl during use of this porous metal body 11. When the framework of porous metal body 11 has a high bending strength, a core member having a small outer diameter can also be used.

When a paper tube having a single tube is used as core member 12, a paper tube having an outer diameter of 75 mm or more and 155 mm or less can be preferably used, for example. In the case of a lightweight porous metal body having a low basis weight, or in the case of a porous metal body for which flatness is regarded as important, it is preferable to use a core member having a larger outer diameter, and, for example, preferable to use a core member having an outer diameter over 155 mm and 350 mm or less. Core member 12 having an outer diameter over 155 mm and formed as a paper tube having a single tube may decrease the physical strength. Thus, it is preferable to use a paper tube having a multi-layered structure or to use a paper tube having a hollow portion into which a reinforcement member is inserted, as described below.

Core member 12 may be made of paper or a resin. Core member 12 made of paper or a resin allows formation of package body 10 that is significantly lightweight as compared with a package body formed using a conventional structural member made of metal. Porous metal body 11 having a framework of a three-dimensional mesh structure as described above is lightweight, and therefore, can prevent crushing of core member 12 even when such porous metal body 11 is wound around core member 12 made of paper or a resin.

Although core member 12 having higher compressive strength is more preferable, core member 12 having appropriate compressive strength may be used so as to prevent an excessive increase in provision cost and weight of core member 12.

The core member made of paper may be a paper tube, for example. Such a paper tube may be made using recycled paper made of used paper as raw materials, such as corrugated cardboard, newspaper, and magazine paper. The strength of the paper tube can be adjusted by the number of turns of paper.

In the package body according to an embodiment of the present disclosure, it is preferable that the core member has a hollow portion in which a reinforcement member is provided. Particularly when a paper tube is used as core member 12 around which porous metal body 11 having a larger basis weight is wound or around which a larger amount of porous metal body 11 is wound, the reinforcement member inserted into the hollow portion of core member 12 can increase the strength of the core member to thereby prevent crushing of the core member.

Figure 3:
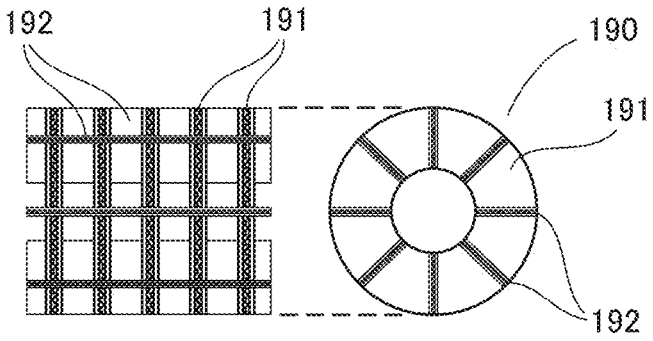
FIG. 3 is a diagram showing an example of a configuration of a reinforcement member that can be inserted into a hollow portion of a core member.
Figure 4:
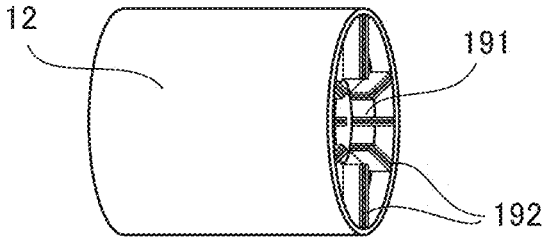
FIG. 4 is a schematic diagram showing the state where the reinforcement member shown in FIG. 3 is inserted into the hollow portion of the core member.

FIG. 3 schematically shows a reinforcement member 190 as an example of the reinforcement member that is inserted into the hollow portion of core member 12 and used in the inserted state. FIG. 4 also shows an arrangement example in which reinforcement member 190 is inserted into the hollow portion of core member 12.

Reinforcement member 190 shown in FIG. 3 is formed of corrugated cardboard and has a structure in which a plurality of pieces of annular corrugated cardboard 191 are coupled by a plurality of pieces of rectangular corrugated cardboard 192. It is preferable that the plurality of pieces of annular corrugated cardboard 191 are disposed at regular intervals and coupled to each other. Also, as the number of pieces of corrugated cardboard 191 is larger, the effect of reinforcing core member 12 becomes higher. Although the number of pieces of rectangular corrugated cardboard 192 is not particularly limited, about six pieces of corrugated cardboard 192 disposed at intervals at equal angles enhances the effect of fixing the plurality of pieces of annular corrugated cardboard 191.

Figure 5:
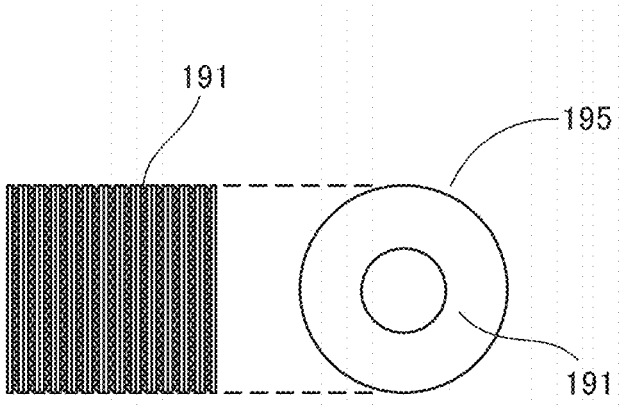
FIG. 5 is a diagram showing another example of the configuration of the reinforcement member that can be inserted into the hollow portion of the core member.
Figure 6:
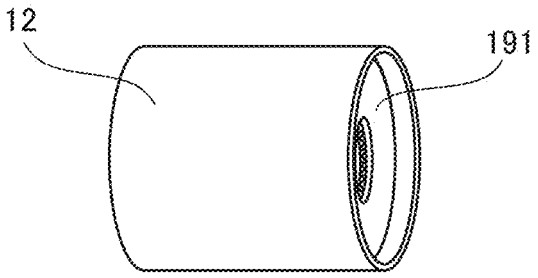
FIG. 6 is a schematic diagram showing the state where the reinforcement member shown in FIG. 5 is inserted into the hollow portion of the core member.

FIG. 5 schematically shows a reinforcement member 195 as another example of the reinforcement member that is inserted into the hollow portion of core member 12 and used in the inserted state. FIG. 6 shows an arrangement example in which reinforcement member 195 is inserted into the hollow portion of core member 12.

Reinforcement member 195 shown in FIG. 5 is configured by a stack of a plurality of pieces of annular corrugated cardboard 191 that are bonded to each other. The plurality of pieces of annular corrugated cardboard 191 may be bonded to each other by any method without particular limitation, and may be bonded to each other by means such as an adhesive agent or an adhesive tape that allows the plurality of pieces of annular corrugated cardboard 191 to be bonded to each other. As the number of pieces of annular corrugated cardboard 191 is larger, a higher effect of reinforcing core member 12 can be achieved.

The core member made of a resin can be adjusted in strength by the type of the resin and the thickness of the core member. Examples of the core member made of a resin may include a core member made of a vinyl chloride resin.

Protective sheet 13 may be provided to cover the outer surface of the main surface of porous metal body 11 wound around core member 12. Package body 10, which has protective sheet 13, can protect porous metal body 11 from impact or the like resulting from contact with other members.

The configuration of protective sheet 13 is not particularly limited but may be any configuration as long as it can alleviate the impacts as mentioned above. FIG. 1 shows an example in which a single-sided corrugated cardboard is used as protective sheet 13. Single-sided corrugated cardboard refers to corrugated cardboard that includes an inner core sheet having only one side surface provided with a liner. When single-sided corrugated cardboard is used as protective sheet 13, it is preferable to wind the single-sided corrugated cardboard around porous metal body 11 in the state where the liner of the single-sided corrugated cardboard faces the outer surface of porous metal body 11.

Resin film 14 may be provided to cover protective sheet 13 and porous metal body 11. Package body 10 having resin film 14 can suppress mixing of foreign matter into porous metal body 11.

Resin film 14 is not particularly limited in configuration, but can be made preferably using a transparent film such as a biaxially stretched polypropylene film, a biaxially stretched nylon film, and a polyethylene terephthalate (PET) film. Resin film 14 having a lower oxygen permeability is more preferable in order to prevent discoloration of porous metal body 11. It is also preferable to select a resin film having the smallest possible thickness from the viewpoint of cost reduction.

Figure 7:
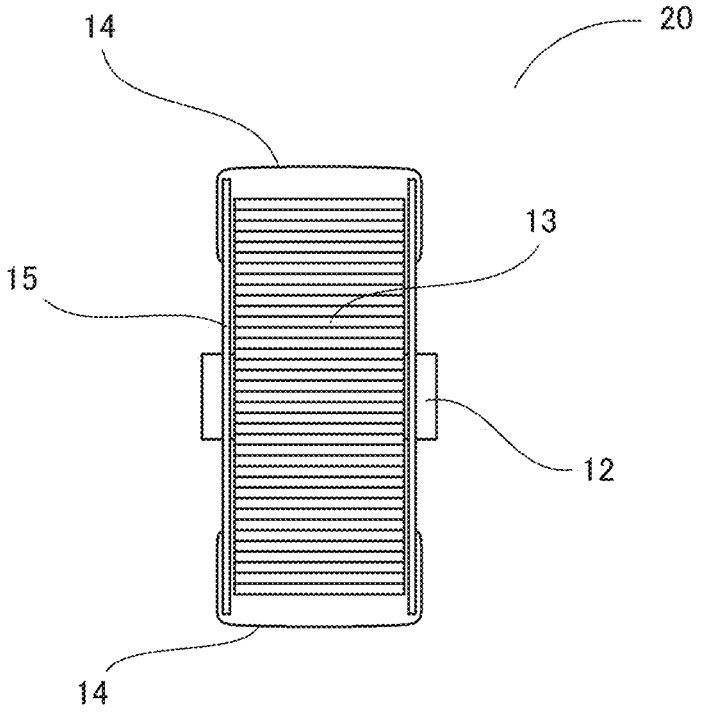
FIG. 7 is a schematic front view of another example of the package body according to the embodiment of the present disclosure.

FIG. 7 shows a schematic front view of another example of the package body according to an embodiment of the present disclosure.

In package body 20 according to an embodiment of the present disclosure, it is preferable that flanges 15 are provided at both end portions of core member 12, as shown in FIG. 7. Flange 15 may be provided in core member 12 so as to be removable from core member 12. For example, a hole suitable to the outer diameter of core member 12 is provided in a center portion of a disk-shaped or polygonal-shaped sheet to thereby allow formation of a flange that can be readily attached and detached.

In package body 20, flange 15 can be readily attached and detached, thereby allowing improvement in the working efficiency during production of package body 20 (i.e., during packaging of porous metal body 11) or during unreeling of porous metal body 11 from package body 20.

For example, when package body 20 is manufactured, porous metal body 11 is wound around core member 12, and thereafter, flange 15 is attached to core member 12, so that flange 15 can be prevented from interfering with the operation. Also, in the state where flange 15 is attached to only one of the end portions of core member 12, porous metal body 11 may be wound around core member 12, and thereafter, a remaining flange 15 may be attached.

Furthermore, porous metal body 11 is unreeled from package body 20 in the state where flange 15 is detached, and thereby, the remaining amount of porous metal body 11 can be readily visually checked.

Since package body 20 according to the embodiment of the present disclosure has flange 15, the side surface portion of porous metal body 11 can be protected from the impact or the like resulting from contact with other members. Also, resin film 14 may be provided to entirely cover flange 15 or may be provided to cover only the upper end portion of the flange so as to cover at least protective sheet 13, as shown in FIG. 7.

When flange 15 has a disk shape, porous metal body 11 wound around core member 12 is evenly fitted inside the flange. Thereby, a package body including porous metal body 11 with a high yield can be provided. Furthermore, when flange 15 has a polygonal shape, package body 20 can be disposed stably in a freestanding manner so as not to fall down when package body 20 is left to stand. For example, flange 15 having an octagonal shape or a decagonal shape can be preferably used.

Flange 15 may be made of any material without particular limitation, but may preferably be made of corrugated cardboard, paper or a resin from the viewpoint of weight reduction of package body 20.

Figure 8:
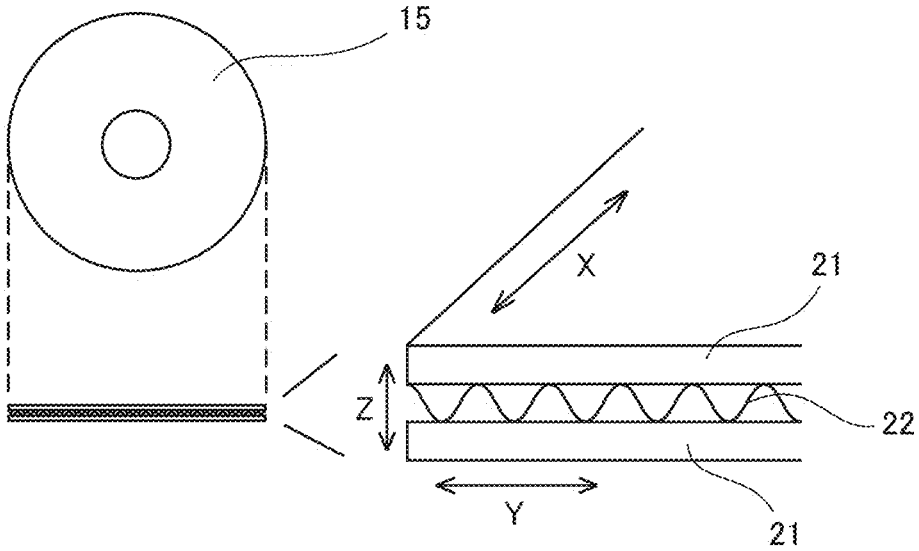
FIG. 8 is a schematic diagram showing an example of a configuration of a flange.

FIG. 8 schematically shows a flange made of corrugated cardboard as an example of the configuration of flange 15. In the example shown in FIG. 8, flange 15 is formed of corrugated cardboard having an inner core sheet 22 sandwiched between two liners 21. The configuration of the corrugated cardboard is not limited to the configuration shown in FIG. 8, but the corrugated cardboard may have a configuration including three or more liners and inner core sheets that are sandwiched between the respective liners. Furthermore, flange 15 may be configured of one piece of corrugated cardboard or may have a multilayer structure formed by stacking two or more pieces of corrugated cardboard.

In the case where flange 15 has a multilayer structure formed by stacking two or more pieces of corrugated cardboard, it is preferable that these pieces of corrugated cardboard are displaced from each other in a paper width direction X. Paper width direction X refers to a direction orthogonal to a corrugation direction Y of inner core sheet 22 and a thickness direction Z of the corrugated cardboard, as shown in FIG. 8. Such a multilayer structure is formed of a plurality of pieces of corrugated cardboard that are displaced from each other in paper width direction X, and thereby, the strength of flange 15 can be further increased. In the multilayer structure formed of a plurality of pieces of corrugated cardboard, the angle of displacement in paper width direction X is preferably "180°/number of pieces". For example, when two pieces of corrugated cardboard are stacked, the displacement in paper width direction X is preferably 90°. When three pieces of corrugated cardboard are stacked, the displacement in paper width direction X is preferably 60°. Thereby, the strength of flange 15 can be further increased.

The strength of flange 15 is not particularly limited, but a higher strength is more preferably from the viewpoints that flange 15 serves to protect the side surface of porous metal body 11 and that flange 15 serves to support its self-weight when package body 20 is left to stand. Flange 15 having appropriate strength may be used so as to prevent an excessive increase in provision cost and weight of flange 15.

In the case where flange 15 is made of corrugated cardboard, the strength can be adjusted by using corrugated cardboard having high strength, or by using a multilayer structure formed of a plurality of pieces of corrugated cardboard that are displaced in angle in the paper width direction.

In the case where flange 15 is made of paper, the strength can be adjusted by changing the thickness and the like.

In the case where flange 15 is made of a resin, the strength can be adjusted by changing the type and the thickness of the resin. In the case where flange 15 is made of a resin, the resin may be selected as appropriate in consideration of the strength and the weight, and may preferably be a vinyl chloride resin, a polyethylene resin, or the like, for example.

Figure 9:
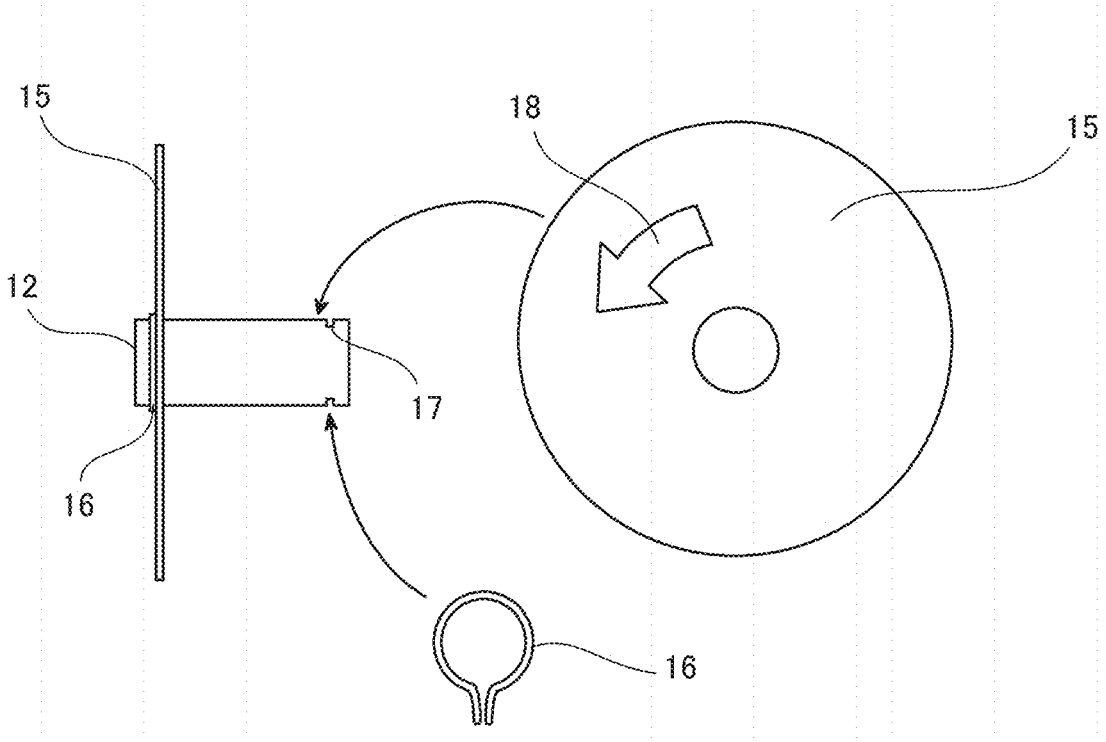
FIG. 9 is a schematic diagram showing an example in which a cramp ring is attached.

In the package body according to an embodiment of the present disclosure, it is preferable that core member 12 includes cramp ring 16 on the outside of flange 15, as shown in FIG. 9. Flange 15 is fixed by cramp ring 16, and thereby, flange 15 can be prevented from detaching from core member 12 during conveyance or the like of package body 20. The raw material of cramp ring 16 is not particularly limited, but may be selected as appropriate and may be iron and the like.

When the position of flange 15 is fixed by cramp ring 16, a groove 17 may be provided at a position on core member 12 at which cramp ring 16 is provided. Groove 17 provided on core member 12 can allow easy attachment of cramp ring 16 and also can suppress displacement of cramp ring 16. In the case where the position of flange 15 on core member 12 is fixed by cramp ring 16, groove 17 is an optional configuration and does not necessarily have to be provided on core member 12.

Furthermore, in package body 20 according to an embodiment of the present disclosure, it is preferable that an indication mark 18 is provided on the outside of flange 15 for indicating the direction in which porous metal body 11 is unreeled. Thereby, when package body 20 is unwound and porous metal body 11 is unreeled, the unreeling direction can be readily checked, so that the burden on an operator can be reduced.

Figure 10:
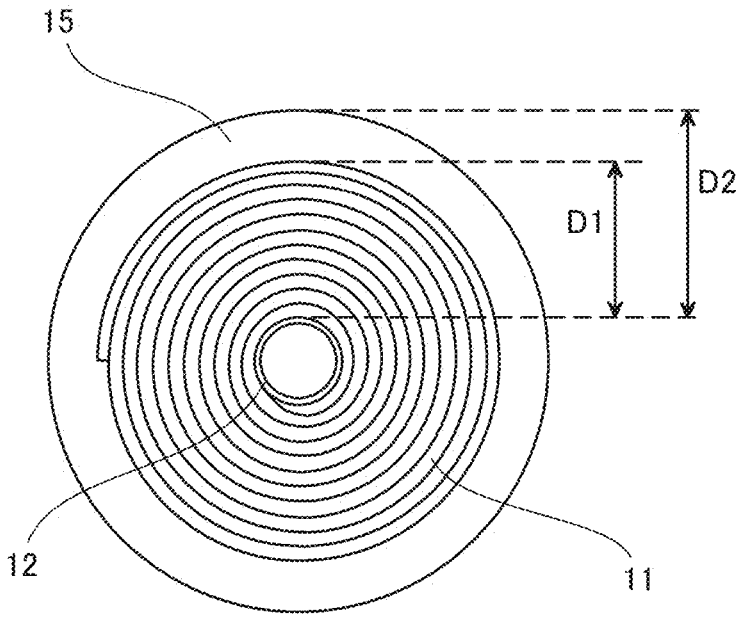
FIG. 10 is a schematic diagram showing the relation between a winding thickness of a porous metal body wound around the core member and a size of the flange.

FIG. 10 schematically shows the relation between a winding thickness of porous metal body 11 wound around core member 12 and a size of flange 15. FIG. 10 does not show protective sheet 13 and resin film 14.

In the case where flange 15 is made of paper, and when a difference (D2–D1) between a distance D2 from the surface of core member 12 to the end portion of flange 15 and a distance D1 from the surface of core member 12 to the outer surface of porous metal body 11 is excessively large, a self-weight of package body 20 may cause bending of an edge portion of flange 15. Furthermore, in the case where flange 15 is made of a resin, and when the difference (D2–D1) between distance D2 and distance D1 is excessively large, the number of stacks of protective sheets 13 needs to be increased, thereby increasing the manufacturing cost of package body 20.

In contrast, an excessively small difference (D2–D1) between distance D2 and distance D1 may prevent a sufficient function of flange 15 to protect porous metal body 11.

From the viewpoints as described above, in package body 20 according to the embodiment of the present disclosure, the difference (D2–D1) between distance D2 and distance D1 is preferably 3 cm or more and 50 cm or less.

Figure 11:
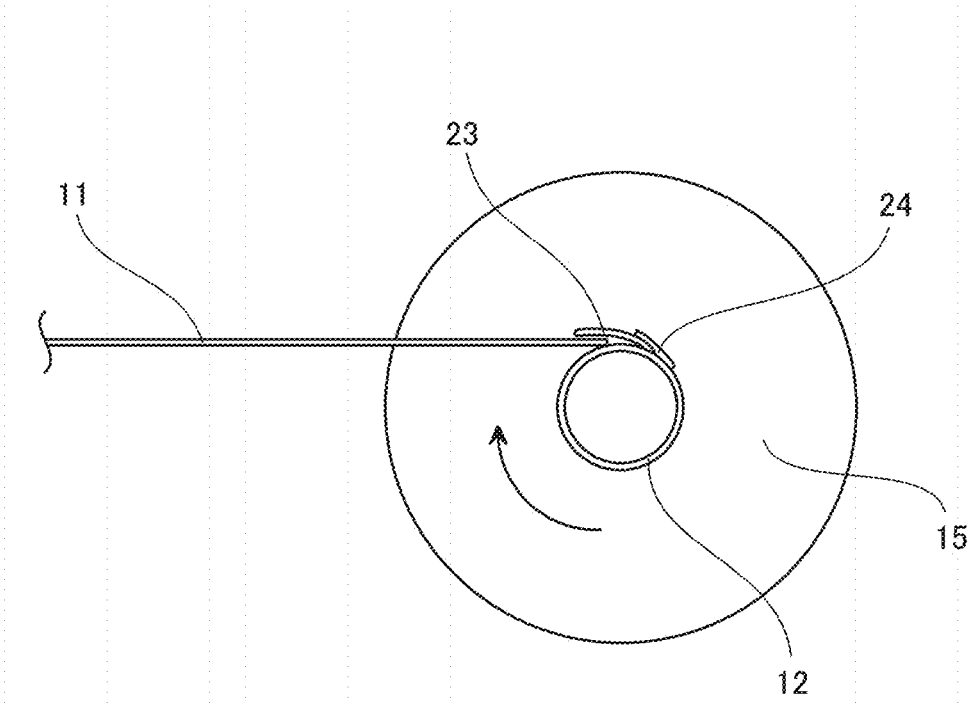
FIG. 11 is a schematic diagram showing an example of a method of fixing the porous metal body and the core member.

FIG. 11 schematically shows an example of a method of fixing porous metal body 11 and core member 12. In the package body according to the embodiment of the present disclosure, the method of fixing porous metal body 11 and core member 12 is not particularly limited, but it is preferable that porous metal body 11 and core member 12 are fixed, for example, by the method shown in FIG. 11.

In the example shown in FIG. 11, only one end portion of a nonwoven fabric 23 is fixed by a tape 24 to core member 12. Then, one end portion of porous metal body 11 is inserted between core member 12 and the end portion of nonwoven fabric 23 that is not fixed onto core member 12. Porous metal body 11 having a framework of a three-dimensional mesh structure intertwines with nonwoven fabric 23 like a hook and loop fastener. Accordingly, the porous metal body is wound in the direction indicated by an arrow shown in FIG. 11, and thereby, porous metal body 11 and core member 12 can be fixed to each other.

The material of nonwoven fabric 23 is not particularly limited, but may be selected as appropriate in accordance with the application of porous metal body 11. Nonwoven fabric 23 is preferably made of a material having a low oxygen permeability or a low organic transfer property, for example, and may be preferably made using a polyester material or the like.

Figure 12:
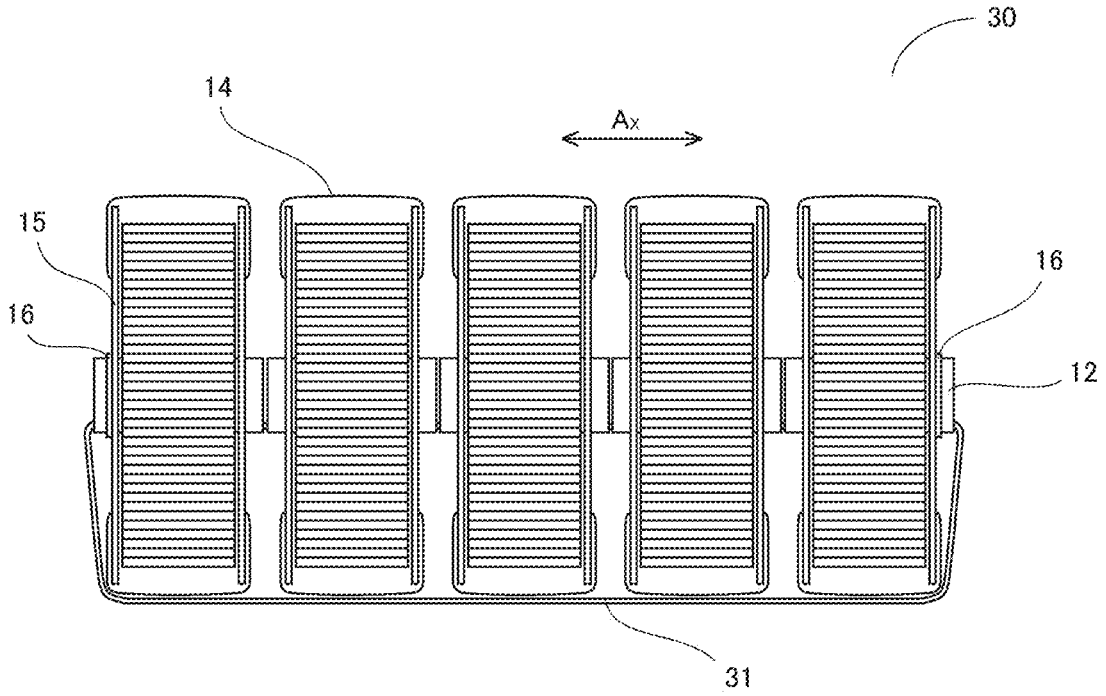
FIG. 12 is a schematic diagram showing an example of the state where the package bodies according to the embodiment of the present disclosure are coupled in parallel.

FIG. 12 schematically shows an example of the state where a plurality of package bodies 20 according to the embodiment of the present disclosure are coupled in parallel. A package body 30 shown in FIG. 12 includes five package bodies 20 that are disposed side by side in an axial direction Ax of core member 12 and coupled integrally by a fixing band 31. Since core member 12 is hollow, fixing band 31 is passed through the hollow portion of this core member for fixation. A plurality of package bodies that are thus coupled can be collectively loaded onto a palette, so that the operation efficiency for conveying the package bodies can be enhanced.

In package body 30, it is preferable that flanges 15 located at both ends of core member 12 in axial direction Ax are fixed by cramp ring 16. Thereby, flanges 15 located at both ends of package body 30 can be prevented from detaching from core member 12 during conveyance and the like. Any flange 15 other than flanges 15 located at both ends of package body 30 may also be fixed by cramp ring 16.

In the package body according to the embodiment of the present disclosure, it is preferable that no metal foreign matter adheres to a porous metal body. Metal foreign matter refers to unintentional adhering substances of metals or alloys other than metals and alloys that form a porous metal body. Furthermore, the metal foreign matter adhering to a porous metal body may be alloyed with metal and an alloy that form a porous metal body. Metal foreign matter may be mixed into a porous metal body mainly by transfer of substances, which adhere to core member 12 or flange 15 in advance, onto a porous metal body.

In order to obtain a package body including a porous metal body to which no metal foreign matter adheres, there may be a method of manufacturing a package body with core member 12 and flange 15 from which metal foreign matter is removed in advance by brushing, wiping, spraying of air, or the like.

A method of detecting metal foreign matter in a package body is not limited, but may be a well-known detection method such as a detection method using a metal detector or X-ray inspection, and a method of eluting metal ion components, for example.

<Method of Manufacturing Package Body>

The following is an explanation about a method of manufacturing a package body according to an embodiment of the present disclosure. The members used in manufacturing a package body may have the same configurations as those of the members described in the explanation about the package body according to the above-described embodiment of the present disclosure.

The method of manufacturing a package body according to the embodiment of the present disclosure includes: winding porous metal body 11 having an elongated sheet shape around core member 12 having a cylindrical shape; winding protective sheet 13 around porous metal body 11 wound in a rolled shape to cover the outer surface of porous metal body 11; and covering protective sheet 13 and porous metal body 11 with resin film 14.

Core member 12 used in this case may be made of paper or a resin. It is preferable that porous metal body 11 and core member 12 are fixed, for example, by nonwoven fabric 23 that is fixed to core member 12 by tape 24, as described above.

The above-mentioned method of manufacturing a package body may include attaching flange 15 to an end portion of core member 12 before covering protective sheet 13 and porous metal body 11 with resin film 14. Thereby, package body 20 having flange 15 can be manufactured without interference between core member 12 and flange 15 in winding porous metal body 11 around core member 12. When flange 15 is attached to core member 12, cramp ring 16 can also be used.

The method of manufacturing a package body according to another embodiment of the present disclosure includes: winding porous metal body 11 around core member 12 having one end portion to which flange 15 is attached; winding protective sheet 13 around the wound porous metal body 11 to cover the outer surface of porous metal body 11; attaching flange 15 to the other end portion of core member 12; and covering protective sheet 13, porous metal body 11, and flange 15 with resin film 14.

Flange 15 is attached to one end portion of core member 12 in advance. Thereby, in winding porous metal body 11 around core member 12, the position at which porous metal body 11 is wound can be readily determined.

The method of manufacturing a package body according to the embodiment of the present disclosure preferably includes removing metal foreign matter from core member 12 or from core member 12 and flange 15. By removing metal foreign matter from core member 12 or flange 15, a package body including a porous metal body to which no metal foreign matter adheres can be manufactured.

The method of removing metal foreign matter from core member 12 or flange 15 is not particularly limited, but may be a method of removing metal foreign matter, for example, by bringing a rotating brush or the like for removing foreign matter into contact with core member 12 and flange 15. In addition to brushing, metal foreign matter may be removed by wiping, spraying of air, and the like.

EXAMPLES

Although the present disclosure will be hereinafter described in greater detail based on Examples, these Examples are given by way of illustration, and the package body and the method of manufacturing the same according to the present invention are not limited thereto. The scope of the present invention is defined by the scope of the claims, and includes any modifications within the scope and meaning equivalent to the scope of the claims.

Example 1

As core member 12, a paper tube with a single tube (obtained from paper tube base paper) was prepared that had a length of 220 mm and an outer diameter of 152 mm (6 inches). The thickness of the paper tube was 13 mm. A nonwoven fabric made of polyester was fixed to the paper tube by tape.

As flange 15, disk-shaped corrugated cardboard was prepared that had an outer diameter of 950 mm and had a center portion provided with a hole with a diameter of 300 mm. Two pieces of corrugated cardboard bonded to each other (K170/P120/S120/P120/K170 (CB/F)) were used. Two pieces of corrugated cardboard were bonded in the state where these pieces of corrugated cardboard were displaced from each other by 90° in the paper width direction.

The corrugated cardboard (flange 15) prepared as described above was attached to one end portion of the above-mentioned paper tube (core member 12) and fixed by a metal ring (cramp ring 16). The metal ring made of stainless steel was used in this case.

Then, a rotating brush was brought into contact with core member 12 and flange 15 to thereby remove metal foreign matter adhering to core member 12 and flange 15.

As porous metal body 11, Celmet (registered trademark) manufactured by Sumitomo Electric Industries, Ltd., was prepared that had a framework having a three-dimensional mesh structure (made of nickel; a porosity of 98%; a pore diameter of 450 μm; a basis weight of 300 g/m$^2$; a thickness of 1.0 mm; a length of 500 m in the long side direction; and a length of 200 mm in the short side direction).

One end portion of Celmet prepared as described above was inserted between the above-mentioned paper tube and a nonwoven fabric, as shown in FIG. 11. Then, the paper tube was rotated to wind Celmet in a rolled shape.

The difference (D2−D1) between distance D2 from the surface of the paper tube to the end portion of the flange and distance D1 from the surface of the paper tube to the outer surface of Celmet was set at 5 cm.

As protective sheet 13, single-sided corrugated cardboard (manufactured by Matsumura Shikou Corporation; AF/K5) was prepared and wound around Celmet to cover the outer surface of Celmet.

The same corrugated cardboard (flange 15) as that described above was attached to the other end portion of the paper tube and fixed by a metal ring (cramp ring 16) in the same manner as described above.

Lastly, the single-sided corrugated cardboard, Celmet, and the corrugated cardboard were covered with a resin film (stretch film KS manufactured by KS HOSO SYSTEM K.K.), to thereby produce a package body. The direction in which Celmet was unreeled was shown by an indication on the corrugated cardboard.

The obtained package body was able to stably hold a porous metal body without causing bending in the end portion of the flange even when the package body was left to stand.

The porous metal body was unreeled from the obtained package body to check whether metal foreign matter existed or not, but no metal foreign matter transferred from the package member was observed.

Example 2

Five package bodies obtained in Example 1 were prepared and arranged as shown in FIG. 12. Then, these five package bodies were fixed by a fixing band passed through hollow portions of the respective paper tubes, thereby allowing production of a package body formed of five package bodies coupled to each other.

Example 3

As core member 12, the same paper tube as that in Example 1 was prepared except that it was a double paper tube having an outer diameter of 300 mm. Reinforcement member 190 shown in FIG. 3 was inserted into the hollow portion of this paper tube and disposed therein, as shown in FIG. 4. Reinforcement member 190 was obtained by five pieces of annular corrugated cardboard 191 that were arranged at regular intervals and coupled by four pieces of corrugated cardboard 192. The outer diameter of each annular corrugated cardboard 191 was 300 mm in accordance with the diameter of the hollow portion of core member 12.

As porous metal body 11, the same porous metal body as that in Example 1 was prepared except that its basis weight was 500 g/m$^2$.

The package body was produced in the same manner as in Example 1 except for use of: porous metal body 11; and core member 12 into which reinforcement member 190 prepared as described above was inserted.

The obtained package body was able to stably hold a porous metal body without causing: crushing of core member 12; and bending in the end portion of the flange even when the package body was left to stand. Furthermore, when the porous metal body was unreeled from the package body, a flat porous metal body that was less likely to curl was able to be obtained.

When the porous metal body was unreeled from the obtained package body to check whether metal foreign matter existed or not, no metal foreign matter transferred from the package member was observed.

REFERENCE SIGNS LIST

10 package body, 11 porous metal body, 12 core member, 13 protective sheet, 14 resin film, 15 flange, 16 cramp ring, 17 groove, 18 indication mark, 190 reinforcement member, 191 annular corrugated cardboard, 192 rectangular corrugated cardboard, 195 reinforcement member, 20 package body, 21 liner, 22 inner core sheet, 23 nonwoven fabric, 24 tape, 30 package body, 31 fixing band, 110 framework, 112 film made of metal or alloy, 113 interior of framework, 114 pore portion.

The invention claimed is:

1. A package body comprising:

a porous metal body having an elongated sheet shape;

a core member having a cylindrical shape and made of paper or a resin, the porous metal body being wound around the core member;

a protective sheet wound around the wound porous metal body to cover the wound porous metal body; and a resin film covering the protective sheet and the wound porous metal body, wherein the core member has an end portion provided with a flange having a disk shape or a polygonal shape, and the flange is provided with an indication mark showing a direction in which the porous metal body is unreeled.

2. The package body according to claim 1, wherein the core member has a hollow portion in which a reinforcement member is provided.

3. The package body according to claim 1, wherein the flange is made of at least one of corrugated cardboard, paper, or a resin.

4. The package body according to claim 1, wherein the flange has a multilayer structure formed by stacking two or more pieces of corrugated cardboard, each of the two or more pieces of corrugated cardboard includes an inner core sheet having a corrugated structure, and the two or more pieces of corrugated cardboard are stacked such that crests of the corrugated structure of one piece of the two or more pieces of corrugated cardboard extend in a direction displaced from a direction in which crests of the corrugated structure of each of other pieces of corrugated cardboard extend.

5. The package body according to claim 1, further comprising a cramp ring, wherein the flange is located between the wound porous metal body and the cramp ring.

6. The package body according to claim 1, wherein a difference between a distance from an outer circumferential surface of the core member to an outer circumferential end portion of the flange and a distance from the outer circumferential surface of the core member to an outermost circumferential surface of the porous metal body wound around the core member is 3 cm or more and 50 cm or less.

7. The package body according to claim 1, wherein the core member has an outer circumferential surface provided with a nonwoven fabric, and one end portion of the porous metal body in a long side direction is fixed between the core member and the nonwoven fabric.

8. The package body according to claim 1, wherein the porous metal body has a framework having a three-dimensional mesh structure, and the framework has a hollow interior.

9. The package body according to claim 1, wherein the porous metal body has a porosity of 50% or more.

10. The package body according to claim 1, wherein the package body is at least one among a plurality of package bodies coupled in parallel.

11. The package body according to claim 1, wherein no metal foreign matter adheres to the porous metal body.

12. A method for manufacturing the package body according to claim 1, the method comprising:

winding a porous metal body having an elongated sheet shape around a core member having a cylindrical shape, the core member being made of paper or a resin;

winding a protective sheet around the wound porous metal body to cover the wound porous metal body; and covering the protective sheet and the wound porous metal body with a resin film.

13. The method for manufacturing the package body according to claim 12, further comprising removing metal foreign matter from the core member or from the core member and the flanges.

14. A method for manufacturing the package body according to claim 1, the method comprising:

winding a porous metal body having an elongated sheet shape around a core member having a cylindrical shape and having one end portion provided with a flange, the core member being made of paper or a resin;

winding a protective sheet around the wound porous metal body to cover the wound porous metal body;

attaching a flange to the other end portion of the core member; and covering the protective sheet, the wound porous metal body, and the flanges with a resin film.

* * * * *